United States Patent [19]

Cox

[11] 4,232,595

[45] Nov. 11, 1980

[54] EXHAUST SYSTEM FOR SMOKESTACK

[75] Inventor: Norman D. Cox, Lansing, Ill.

[73] Assignee: Jefco Laboratories, Incorporated, Chicago, Ill.

[21] Appl. No.: 915,941

[22] Filed: Jun. 15, 1978

[51] Int. Cl.[3] ..... F23J 13/00; F23L 17/02

[52] U.S. Cl. ..... 98/59; 110/184; 251/212

[58] Field of Search ..... 110/184; 98/58-60; 251/212

[56] References Cited

U.S. PATENT DOCUMENTS

| | | | |
|---|---|---|---|
| 2,508,615 | 5/1950 | Lukes | 98/59 |
| 2,557,213 | 6/1951 | Artis | 98/59 |
| 2,608,278 | 9/1971 | Greenspan | 110/184 |
| 2,649,272 | 8/1953 | Barbato | 251/212 |
| 2,830,617 | 4/1958 | Brown | 251/212 |
| 2,934,892 | 5/1960 | Harlbert et al. | 251/212 |
| 3,181,451 | 5/1965 | Hess | 98/59 |
| 3,706,290 | 12/1972 | Holland | 110/184 |
| 4,094,492 | 6/1978 | Beeman et al. | 251/212 |
| 4,095,514 | 6/1978 | Roy et al. | 110/184 |

*Primary Examiner*—Henry C. Yuen

*Attorney, Agent, or Firm*—Merriam, Marshall & Bicknell

[57] ABSTRACT

A smokestack for boilers or the like has an exhaust control system on the top opening of the smokestack to change the size of the orifice through which the gaseous exhaust exits. Structure is provided for automatically adjusting the size of the orifice in response to changing pressure conditions within the smokestack to maintain the orifice at an optimum size for the conditions prevailing at a given time.

3 Claims, 6 Drawing Figures

EXHAUST SYSTEM FOR SMOKESTACK

BACKGROUND OF THE INVENTION

The present invention relates generally to smokestacks for combustion chambers such as boilers, furnaces or the like, and more particularly to exhaust control structure for such smokestacks.

A smokestack typically comprises a lower portion communicating with the exhaust port of a combustion chamber, such as a boiler, and a top opening communicating with the atmosphere. Among the problems arising with conventional smokestacks are the condensation of water vapor from the exhaust gas stream within the smokestack, causing corrosion or other adverse effects in the smokestack. Another problem is pulsations within the boiler, accompanied by a pulsating exhaust stream coming out of the top of the smokestack, indicative of less than optimum combustion in the boiler.

Holland, U.S. Pat. No. 3,706,290, describes structure for reducing the above-noted drawbacks. This structure is in the form of an exhaust control device overlying the top opening of the smokestack and in the form of a substantially flat plate having a sharp-edged circular orifice overlying the interior of the smokestack. This device causes the formation of an annular insulating blanket of exhaust gases around the periphery of the smokestack interior and a uniformly flowing stream of exhaust gases passing steadily up the center of the annulus. The net effect of this is to avoid condensation of water vapor within the smokestack and to eliminate pulsating within the boiler and from the smokestack. These effects in turn promote a cleaner, hotter exhaust leaving the smokestack, improve the completeness of combustion, reduce fuel consumption and reduce uncombusted or pungent gases in the exhaust stream.

In order to best accomplish the advantages of the device described in the Holland patent, the exhaust control orifice should have a cross-sectional area corresponding to the effective size of the exhaust port in the combustion chamber or boiler. When more than one boiler is being used, the orifice should have a size corresponding to the combined cross-sectional areas of all the exhaust ports on all the boilers.

However, when there is a change in the number of boilers operating or when there is a change in the operating conditions in a given boiler, the orifice size which is optimum for an initial set of conditions may no longer be optimum.

The considerations involved in the selection of the exhaust control orifice size and the advantages flowing therefrom are described in greater detail in said Holland U.S. Pat. No. 3,706,290, and the disclosure thereof is incorporated herein by reference.

SUMMARY OF THE INVENTION

The present invention overcomes the drawbacks arising when there is a change in the conditions from those existing when the size of the exhaust control orifice was initially selected. In accordance with the present invention, structure is provided which is actuable to adjust the size of the orifice and a mechanism is provided for automatically actuating the adjusting structure in response to a change in the conditions within the smokestack.

At the time of installation, the size of the orifice is initially adjusted until optimum results are obtained, and the pressure within the smokestack under these optimum results is noted or measured. This pressure measurement is set into a controller constituting part of the mechanism for actuating the adjusting structure. The controller senses the pressure within the smokestack, and the controller is operable to actuate the adjusting structure in response to a sensed pressure which is above or below the predetermined pressure setting in the controller.

The pressure within the smokestack is continuously monitored by the controller. Thus, when the pressure within the smokestack departs from the pressure setting in the controller, this is sensed by the controller which operates in response thereto to actuate the structure for adjusting the size of the orifice to change the size of the orifice until the smokestack pressure sensed by the controller again corresponds to the pressure setting in the controller.

A pressure within the smokestack greater than the predetermined pressure setting will cause the controller to actuate the orifice adjusting structure to increase the size of the orifice to lower the pressure in the smokestack. A pressure within the smokestack lower than the predetermined pressure setting will cause the controller to actuate the orifice adjusting structure to decrease the size of the orifice to raise the pressure in the smokestack.

Other features and advantages are inherent in the structure claimed and disclosed or will become apparent to those skilled in the art from the following detailed description in conjunction with the accompanying diagrammatic drawings.

DETAILED DESCRIPTION

Figure 1:
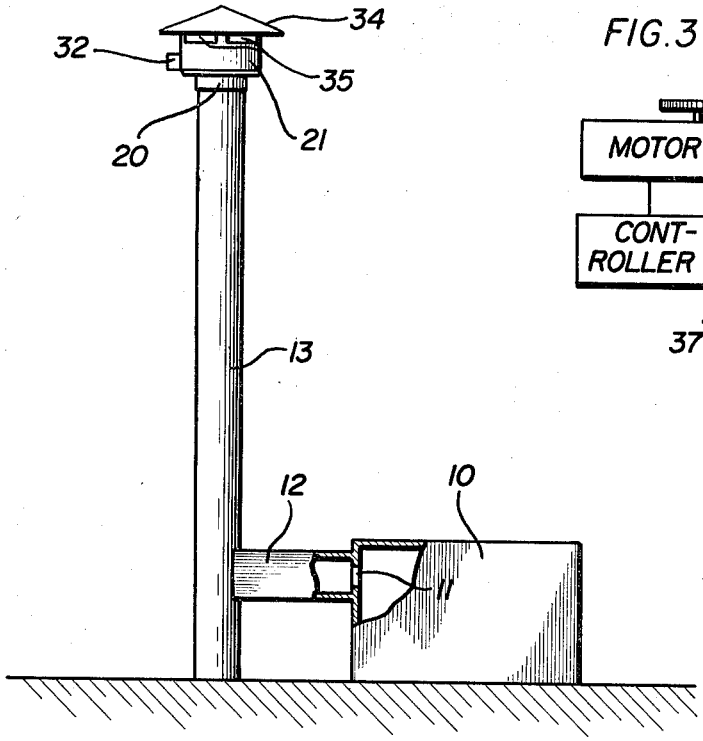
FIG. 1 is an elevational view of a smokestack and exhaust system constructed in accordance with an embodiment of the present invention.
Figure 2:
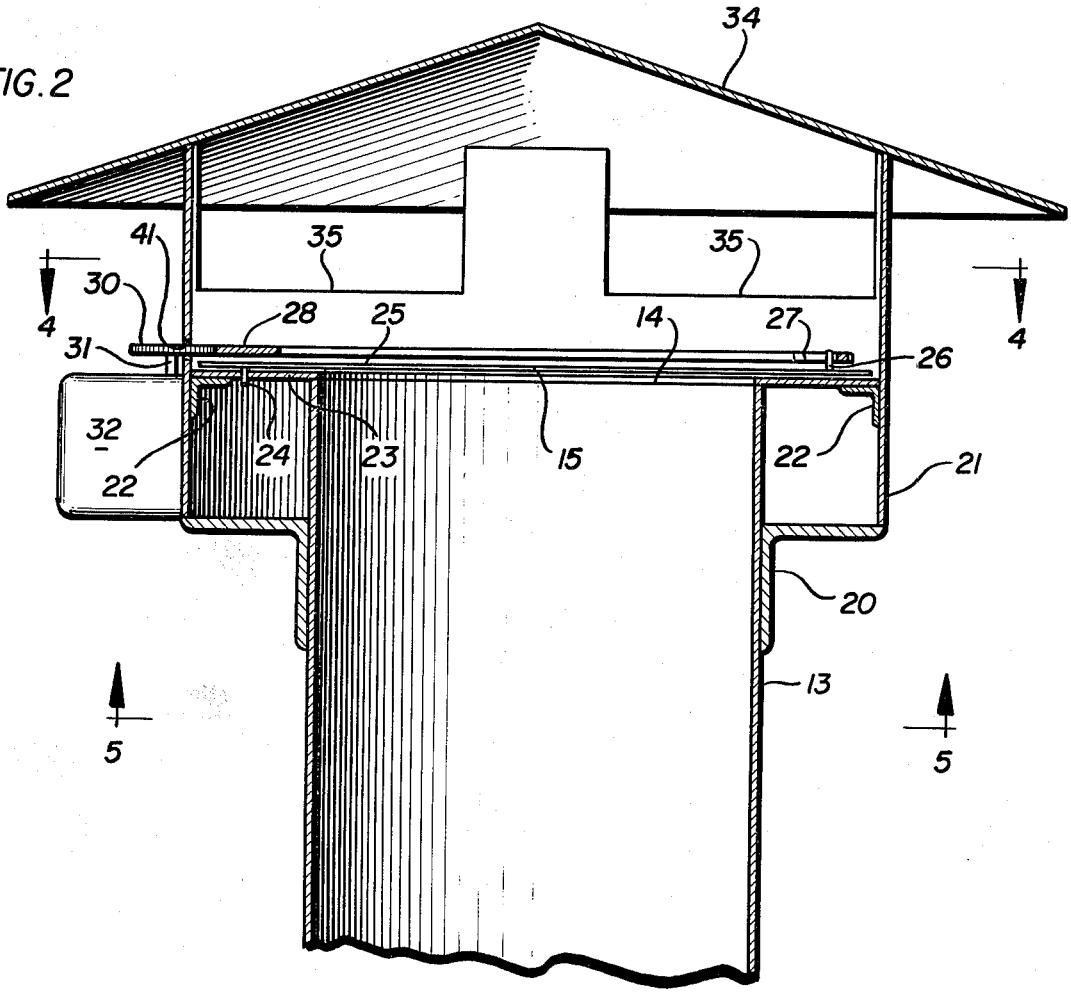
FIG. 2 is an enlarged fragmentary view of the top portion of the smokestack showing the exhaust control device located there.
Figure 4:
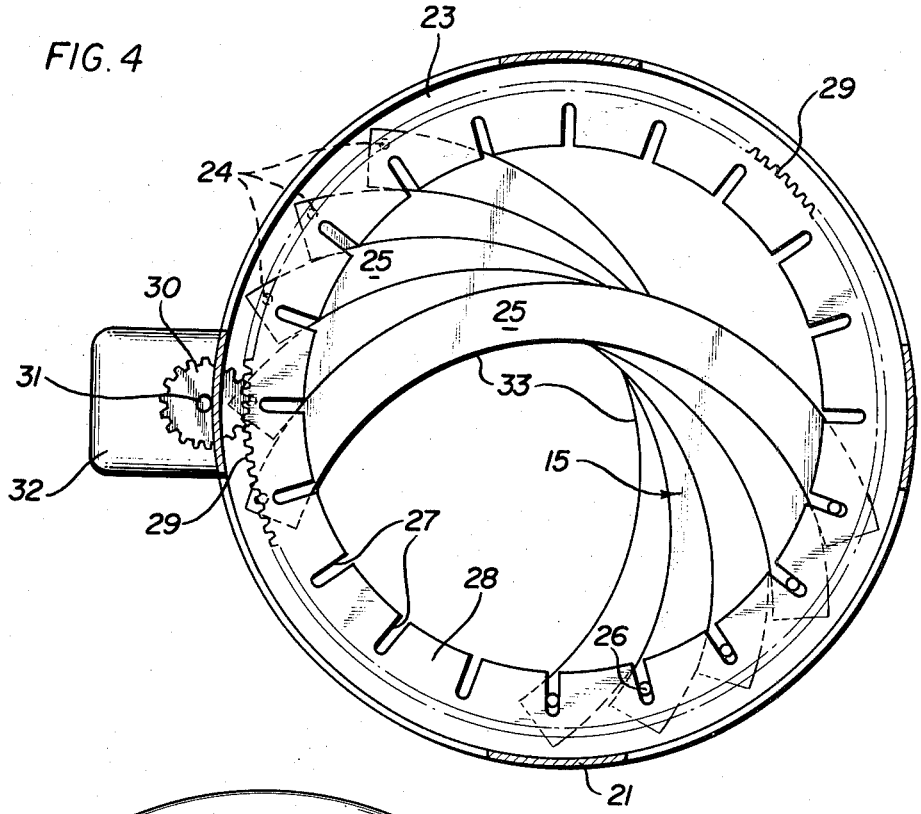
FIG. 4 is a sectional view taken along line 4—4 in FIG. 2.
Figure 5:
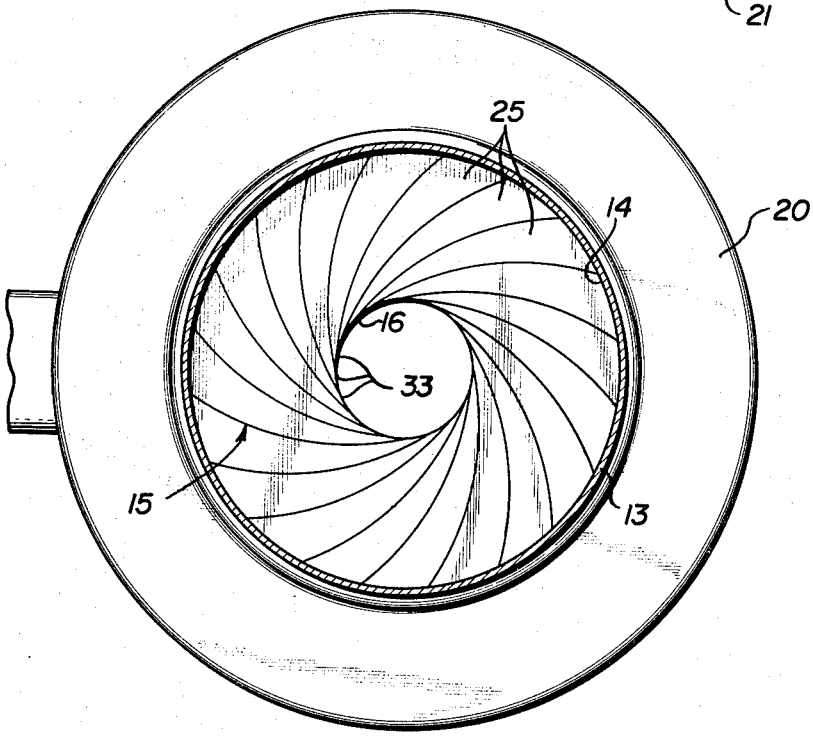
FIG. 5 is a sectional view taken along line 5—5 in FIG. 2.

Referring initially to FIG. 1, indicated at 10 is a combustion chamber or boiler having an exhaust port 11 communicating with an exhaust duct 12 in turn communicating with the lower portion of a smokestack 13 having a top opening 14 (FIG. 2). Referring to FIGS. 2 and 4–5, an exhaust control device 15 overlies top opening 14 of the smokestack, and exhaust control device 15 has an orifice 16 (FIG. 5) the size of which is adjustable. The details of the exhaust control device 15 and structure for adjusting the size of orifice 16 will now be described.

Referring to FIGS. 2 and 4–6, mounted around the periphery of smokestack 13 is an annular bracket 20 having in inverted L-shaped cross-section. Mounted atop bracket 20 is a cylindrical member 21, and attached to the interior of member 21 are a plurality of angle-shaped brackets 22 upon which is fixed an annular ring 23. Extending upwardly from annular ring 23 are a plurality of pins 24, 24 pivotally mounted on ring 23. Each pin 24 is fixed to one end of a respective one of a plurality of crescent-shaped leaves 25, 25. Extending upwardly from each leaf 25 at an end of each opposite that end to which pin 24 is fixed, is a second pin 26. Each pin 26 is pivotally mounted on its leaf 25 and has an upper end 40 (FIG. 6) engaged in one of a plurality of slots 27, 27 in a rotatable ring 28. A peripheral portion of ring 28 includes a plurality of teeth 29, 29 engaged by a gear 30 on a shaft 31 driven by a motor 32. Gear 30 extends through a slot 41 in cylindrical member 21 to engage teeth 29, 29 (FIG. 2).

Figure 6:
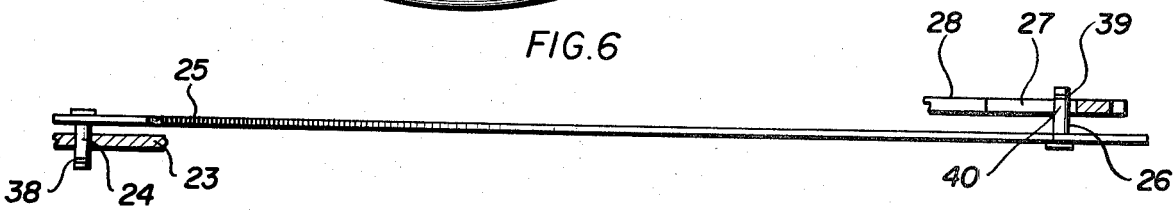
FIG. 6 is a fragmentary side view of a portion of the orifice adjusting structure.

Referring to FIGS. 2 and 6, pin 24 has a groove 38 (FIG. 6) for receiving a spring retaining clip or "E" ring (not shown) below annular ring 23 to retain pin 24 in engagement with ring 23. Similarly, pin 26 has a groove 39 (FIG. 6) for receiving a spring retaining clip or "E" ring (not shown) above rotatable ring 28 to retain pin 26 in engagement with ring 28. In lieu of grooves and retaining clips or rings on pins 24, 26, the pins may be retained in engagement with rings 23 and 28 respectively with cotter pins or cotter pins and washers.

Annular ring 23, pins 24, 24 crescent leaves 25, 25 pins 26, 26 slots 27, 27 and rotatable ring 28 together define an iris-type closure structure. The inner edges of leaves 25, 25 on the iris define orifice 16.

Motor 32 is reversible. Thus, in operation, motor 32 can be driven in one direction to drive shaft 31, gear 30, and rotatable ring 28 in a first sense to reduce the size of orifice 16 in the iris, or motor 32 can be driven in an opposite direction to drive rotatable ring 28 in an opposite sense to enlarge the size of orifice 16 in the iris. When the iris is adjusted to its maximum open position, orifice 16 has a cross-sectional area less than the cross-sectional area of smokestack 13, and when the iris is adjusted to its maximum closed position, orifice 16 has a cross-sectional area less than the cross-sectional area it has when the iris is in its maximum open position, but the iris is still partially open.

An advantage of an iris-type closure structure of the kind illustrated in the drawings is that, when the cross-sectional area of orifice 16 is adjusted, the adjustment is uniform around the periphery of the orifice.

Referring to FIGS. 1 and 2, cylindrical member 21 is covered with a rain cap 34 and has a plurality of outlet openings 35 through which exhaust gases may exit after passing upwardly through orifice 16 in exhaust control device 15.

Figure 3:
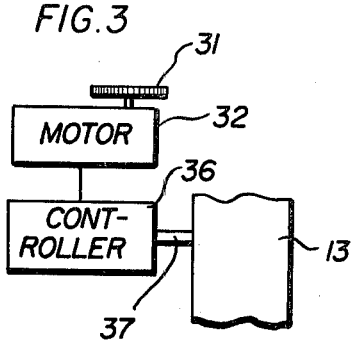
FIG. 3 is a schematic diagram of structure used in controlling the size of the orifice.

The direction in which reversible motor 32 turns determines whether orifice 16 is enlarged or reduced in size, and the direction in which motor 32 turns in turn is determined by a controller 36 (FIG. 3). Controller 36 operates in response to the pressure which the controller senses within smokestack 13 through a conduit 37 communicating with the interior of smokestack 13. Controller 36 will operate motor 32 in one direction, when the pressure sensed by the controller is below a predetermined pressure setting, and in another direction when the pressure sensed by the controller is above a predetermined pressure setting.

In a typical embodiment, the smokestack pressure communicated to controller 36 actuates a diaphragm in the controller which actuates switch means in the controller to operate motor 32. A manually adjustable predetermined pressure setting in controller 36 determines the limits within which the switching means is operative. Controller 36 is of conventional construction and is commercially available. An example of a controller useful in conjunction with the present invention is described in Bulletin DCR-AS-DS-940.01 of Cleveland Controls, Incorporated, Cleveland, Ohio.

Controller 36 may be mounted on annular ring 20 or cylindrical member 21.

When an exhaust control system in accordance with the present invention is initially installed atop a smokestack, the size of the orifice is initially adjusted until optimum results are obtained. The pressure within the smokestack 13 is then measured and this pressure level is set into controller 36. Thereafter, the pressure within smokestack 13 is continuously monitored by controller 36. When the pressure sensed within smokestack 13 deviates from the predetermined pressure setting in the controller, controller 36 causes motor 32 to turn in a direction which adjusts the size of orifice 16 which changes the pressure in smokestack 13 until that pressure again corresponds to the predetermined pressure setting in controller 36, a pressure which gives the optimum results.

For example, if the pressure sensed within smokestack 13 is below the predetermined pressure setting in controller 36, controller 36 operates motor 32 to close orifice 16 to a smaller size, thereby increasing the pressure within smokestack 13. On the other hand, if the pressure sensed within smokestack 13 is above the predetermined pressure setting in controller 36, controller 36 causes motor 32 to open orifice 16 to reduce the pressure within smokestack 13.

The pressure setting in controller 36 may be a range having maximum and minimum limits, and, in such a case, the controller operates the orifice adjusting motor when the pressure sensed in the smokestack is outside these limits.

Thus, the exhaust control device atop smokestack 13 will automatically compensate for changing conditions in the combustion system connected to smokestack 13. The changing conditions include a change in the number of boilers exhausting into smokestack 13 at a given time or a change in the conditions for a particular individual boiler exhausting into smokestack 13.

The controller may comprise a temperature over-ride set to automatically operate the motor to increase the size of the orifice when the temperature in the smokestack exceeds a predetermined level. In such an arrangement, the controller would be coupled with a temperature sensing device which measures the temperature in the smokestack and communicates the measured temperature to the controller into which the predetermined temperature level has been set. A temperature over-ride of the type described is conventional and commercially available with controllers of the type described.

The foregoing detailed description has been given for understanding only, and no unnecessary limitations should be understood therefrom, as modifications will be obvious to those skilled in the art.

What is claimed is:

1. An exhaust system for removing gaseous combustion products from a combustion chamber having an exhaust port, said exhaust system comprising:

a vertically disposed smokestack having a lower portion communicating with the exhaust port of said combustion chamber and a top opening communicating with the atmosphere;

an exhaust control device overlying said top opening of the smokestack;

said exhaust control device being substantially flat and lying in a substantially horizontal plane and having a sharp-edged circular orifice overlying the interior of said smokestack;

said exhaust control device comprising means for forming an annular insulating blanket of exhaust gases around the periphery of the smokestack interior and a uniformly flowing stream of exhaust gases passing steadily up the center of the annulus;

said substantially flat exhaust control device comprising adjustable means actuable to adjust the size of said orifice while maintaining said annular insulating blanket and said uniformly flowing stream of exhaust gases, said adjustable means comprising movable closure means defining said sharp-edged circular orifice and lying substantially entirely in said substantially horizontal plane;

and means for actuating said adjustable means in response to a change in conditions within said smokestack, reflecting a change in the number of boilers connected to said smokestack or a change in the operating conditions in a given boiler, to change the orifice size to one which will return the conditions existing before said change, said orifice adjusting means comprises:

closure means;

and means mounting said closure means for movement between a first position in which said orifice has a first cross-sectional area less than the cross-sectional area of said smokestack and a second position in which said orifice is partially open and has a second cross-sectional area less than said first cross-sectional area thereof, said closure means comprises means for adjusting the cross-sectional area of said orifice uniformly around the periphery of the aperture, said closure means comprises an iris-type structure, said actuating means comprises means responsive to a change in pressure within said smokestack, said pressure-responsive actuating means comprises:

driving means operable in a first direction to close said closure means and operable in a second direction to open said closure:

controller means, responsive to a sensed pressure which is below a predetermined pressure setting, for operating said driving means in said first direction and, responsive to a sensed pressure which is above said predetermined pressure setting, for operating said driving means in said second direction;

and means for communicating to said control means the pressure with said smokestack.

2. An exhaust system as recited in claim 1 wherein:

said first position of the closure means is a maximum open position and said second position is a maximum closed position.

3. An exhaust system as recited in claim 1 wherein:

said actuating means comprises means responsive to a change in pressure within said smokestack from a predetermined level for adjusting the size of said orifice to return said pressure within the smokestack to said predetermined level.

* * * * *